US007497533B2

(12) United States Patent
Remmers

(10) Patent No.: US 7,497,533 B2
(45) **Date of Patent: *Mar. 3, 2009**

(54) SHELVES, RESILIENT DRAWER STOPS, AND DRAWER BRACKETS FOR SUPPORTING SHELVES AND DRAWERS

(75) Inventor: Lee E. Remmers, Ocala, FL (US)

(73) Assignee: Clairson, Inc., Newark, DE (US)

( * ) Notice: Subject to any disclaimer, the term of this patent is extended or adjusted under 35 U.S.C. 154(b) by 463 days.

This patent is subject to a terminal disclaimer.

(21) Appl. No.: 11/325,645

(22) Filed: Jan. 4, 2006

(65) Prior Publication Data

US 2006/0113443 A1 Jun. 1, 2006

Related U.S. Application Data

(63) Continuation-in-part of application No. 29/244,571, filed on Dec. 12, 2005, now Pat. No. Des. 547,640, which is a continuation-in-part of application No. 10/424,681, filed on Apr. 28, 2003, now Pat. No. 7,021,730, application No. 11/325,645, which is a continuation-in-part of application No. 10/424,681.

(51) Int. Cl.
*A47B 96/00* (2006.01)
*A47G 29/02* (2006.01)

(52) U.S. Cl. ..... 312/404; 312/408; 248/235; 211/90.01; 108/108

(58) Field of Classification Search ..... 248/235, 248/247, 248, 250, 300, 316.8; 211/90.02, 211/99.03, 44.02, 215, 90.01; 108/152, 108, 108/26; 312/404, 408
See application file for complete search history.

(56) References Cited

U.S. PATENT DOCUMENTS 766,605 A 8/1904 Dilg
1,176,588 A 3/1916 Miller et al.
1,677,764 A 7/1928 Gloekler (Continued)

FOREIGN PATENT DOCUMENTS

AT 260460 3/1968

(Continued)

OTHER PUBLICATIONS

U.S. Appl. No. 29/244,571, filed Dec. 12, 2005, Remmers.

(Continued)

*Primary Examiner*—Anita M King
(74) *Attorney, Agent, or Firm*—Harness, Dickey & Pierce, P.L.C.

(57) ABSTRACT

According to various aspects of the present disclosure, there are provided various exemplary embodiments of shelves, resilient drawer stops, and drawer brackets mountable to wall-mounted standards for supporting shelves and drawers. In one exemplary embodiment, an apparatus includes at least one shelf member, at least one bracket, and at least one resilient drawer stop. The bracket includes at least one engagement member for engaging a standard to mount the bracket to the standard, a support surface disposed generally horizontally when the bracket is mounted to the standard to slidably support a portion of a drawer, and a shelf support adjacent the support surface for supporting the shelf member. The resilient drawer stop is configured to resist completely sliding a drawer from the bracket's support surface.

18 Claims, 13 Drawing Sheets

U.S. PATENT DOCUMENTS

| | | | | |
|---|---|---|---|---|
| 1,953,688 | A | 4/1934 | Otte | |
| 1,973,416 | A | 9/1934 | Otte | |
| 2,033,860 | A | 3/1936 | Otte | |
| 2,033,861 | A | 3/1936 | Otte | |
| 2,057,429 | A | 10/1936 | Heim | |
| 2,080,907 | A | 5/1937 | Buchanan | |
| 2,319,470 | A * | 5/1943 | Nobles | 211/153 |
| 2,750,052 | A | 6/1956 | Brown et al. | |
| 2,875,016 | A | 2/1959 | Fry | |
| 2,956,766 | A | 10/1960 | Galassi | |
| 3,041,033 | A * | 6/1962 | Schwartz | 248/248 |
| 3,092,047 | A | 6/1963 | Chesley | |
| 3,099,501 | A | 7/1963 | Hillson et al. | |
| 3,135,491 | A | 6/1964 | Knape et al. | |
| 3,185,426 | A | 5/1965 | Bjerke | |
| 3,207,100 | A | 9/1965 | Peacock | |
| 3,233,852 | A | 2/1966 | Azar | |
| 3,269,556 | A | 8/1966 | Streater | |
| 3,338,541 | A | 8/1967 | Kellogg | |
| 3,353,684 | A | 11/1967 | Chesley | |
| 3,355,134 | A | 11/1967 | Chesley | |
| 3,677,615 | A | 7/1972 | Hudson | |
| 3,701,325 | A | 10/1972 | Fenwick | |
| 4,098,480 | A | 7/1978 | Neumann | |
| 4,121,876 | A | 10/1978 | Ratti | |
| 4,589,349 | A | 5/1986 | Gebhardt et al. | |
| 4,597,616 | A * | 7/1986 | Trubiano | 312/246 |
| 4,624,376 | A | 11/1986 | Bertram | |
| 4,720,069 | A | 1/1988 | Bessinger | |
| 4,732,284 | A | 3/1988 | Remmers | |
| 4,735,470 | A | 4/1988 | Falk | |
| D295,950 | S | 5/1988 | Johnston | |
| 4,776,472 | A | 10/1988 | Rosen | |
| 4,783,035 | A | 11/1988 | Remmers | |
| 4,792,195 | A | 12/1988 | Adriaansen et al. | |
| D323,088 | S | 1/1992 | Fler | |
| 5,086,936 | A | 2/1992 | Remmers | |
| 5,205,630 | A | 4/1993 | Welch et al. | |
| D341,819 | S | 11/1993 | Carlstrom | |
| 5,346,077 | A | 9/1994 | Randall | |
| 5,486,046 | A | 1/1996 | Jernstrom et al. | |
| 5,507,398 | A | 4/1996 | Miller | |
| 5,524,981 | A | 6/1996 | Herrmann et al. | |
| 5,531,464 | A | 7/1996 | Maurer et al. | |
| 5,580,018 | A | 12/1996 | Remmers | |
| 5,592,886 | A | 1/1997 | Williams et al. | |
| 5,605,238 | A | 2/1997 | Jacobs | |
| 5,641,217 | A | 6/1997 | Caruso et al. | |
| 5,720,230 | A | 2/1998 | Mansfield | |
| 5,752,610 | A | 5/1998 | Remmers | |
| 5,803,274 | A | 9/1998 | Scheveloff | |
| 5,810,179 | A | 9/1998 | Kleiman | |
| D408,175 | S | 4/1999 | Daniels et al. | |
| 5,909,936 | A | 6/1999 | Daniels et al. | |
| 5,921,412 | A * | 7/1999 | Merl | 211/90.03 |
| 6,024,333 | A * | 2/2000 | Raasch et al. | 248/247 |
| D425,754 | S | 5/2000 | Matteson | |
| 6,070,957 | A | 6/2000 | Zachrai | |
| 6,082,690 | A * | 7/2000 | Durin et al. | 248/241 |
| 6,467,860 | B2 | 10/2002 | Remmers | |
| 6,497,185 | B1 | 12/2002 | Barrett et al. | |
| 6,505,800 | B1 | 1/2003 | Abdullah | |
| 6,729,704 | B2 | 5/2004 | Ames | |
| 6,799,523 | B1 | 10/2004 | Cunha | |
| 6,953,176 | B2 | 10/2005 | Remmers | |
| 6,976,596 | B2 | 12/2005 | Brooks | |
| 7,021,730 | B2 * | 4/2006 | Remmers | 312/404 |
| 7,086,544 | B1 * | 8/2006 | Doench | 211/105.1 |
| 7,104,411 | B2 * | 9/2006 | Magnusson et al. | 211/90.01 |
| 7,300,122 | B2 * | 11/2007 | Vardon | 312/408 |
| 7,314,144 | B2 * | 1/2008 | Stitchick et al. | 211/125 |
| 2004/0112852 | A1 | 6/2004 | Brooks | |
| 2004/0211869 | A1 | 10/2004 | Remmers | |
| 2005/0011420 | A1 | 1/2005 | Costa et al. | |

FOREIGN PATENT DOCUMENTS

| | | |
|---|---|---|
| GB | 361068 | 11/1931 |
| GB | 365254 | 1/1932 |
| GB | 939044 | 10/1963 |
| GB | 2236243 A | 4/1991 |

OTHER PUBLICATIONS

SPUR® Schulte, The Premier Adjustable Shelving Hardware System, Schulte Corporation, Fast and Easy Installation, 1 page.
SPUR® Schulte, The Premier Adjustable Shelving Hardware System, Schulte Corporation, Select your SPUR® Brackets, 1 page.
SPUR® Schulte, Introducing Quick-Change Artistry, Schulte Corporation, 2 pages.
NewTech Hardware, Heavy Duty Adjustable Steel Shelving, Installation Guides, 1 page.
NewTech Hardware, Heavy Duty Adjustable Steel Shelving, NewTech Accessory Brackets, 1 page.

* cited by examiner

SHELVES, RESILIENT DRAWER STOPS, AND DRAWER BRACKETS FOR SUPPORTING SHELVES AND DRAWERS

CROSS-REFERENCE TO RELATED APPLICATIONS

This application is a continuation-in-part of presently allowed U.S. patent application Ser. No. 10/424,681 filed Apr. 28, 2003. This application is a continuation-in-part of U.S. Design patent application Ser. No. 29/244,571 filed Dec. 12, 2005, which is a continuation-in-part of presently allowed U.S. patent application Ser. No. 10/424,681 filed Apr. 28, 2003. The present disclosures of the above applications are incorporated herein by reference.

FIELD

The present disclosure relates to shelves, resilient drawer stops, and drawer brackets mountable to wall-mounted standards for supporting shelves and drawers.

BACKGROUND

The statements in this section merely provide background information related to the present disclosure and may not constitute prior art.

Efficient and organized use of space is very desirable, particularly with respect to storage or utility space in businesses, residential homes and apartments. From appliances having space-saving designs (e.g., washer and drawer stacked on top of one another) to storage organizer units (e.g., wall-mounted wire shelving kits), manufacturers continue to develop new designs to increase use of space, while maintaining ease in access and user convenience.

With respect to the design of storage units, such as closet storage units for residential use, many different options are available including, for example, different sizes and shapes of shelves, different attachment and mounting members (e.g., brackets and standards, etc.) and different storage members (e.g., wire baskets, shoe stands, tie/belt racks, etc.). Ease in accessing stored items such as clothing is typically important. Further, flexibility in design and increasing use of available space is likewise typically important.

Wall-mounted standards are used in connection with brackets for constructing storage systems in which shelves are supported on top of the brackets. These systems allow for connection of the brackets to different portions (e.g., slots, etc.) of the standards to allow for flexibility in the vertical positioning of shelves supported by the brackets. Typically, ventilated shelving or other types of shelving (e.g., wooden shelves, etc.) are supported above and on the brackets to maintain the shelves in a generally horizontal orientation for storage of items thereon.

Using known standards and brackets, flexibility in storage design and use of storage space is typically limited to shelving attached and supported by the brackets. In particular, items may be stored on the shelves supported by the brackets, hung from the wires (e.g., longitudinally extending support wires) of the shelves or hung from a hang rod attached to the shelves. However, use of the storage area below the shelves supported by the brackets is limited, and if used, often difficult to access and/or difficult to move items stored, and in particular hung thereunder. Thus, although known standards and brackets allow for changing the vertical positioning of shelves, use of the storage space is often not maximized or efficiently used, and it may be difficult to access certain items stored under or next to the shelves. Further, additional units, for example, stand alone basket units often have to be used, for example, on the floor under the lowest shelf, to provide more efficient use of the space. This can add cost to the storage units, and these basket units are often difficult to install because of the amount of available space and the size of the particular basket unit.

SUMMARY

According to various aspects of the present disclosure, there are provided various exemplary embodiments of shelves, resilient drawer stops, and drawer brackets mountable to wall-mounted standards for supporting shelves and drawers. Other aspects include systems and apparatus including one or more of such shelves, resilient drawer stops, and/or drawer brackets.

In one exemplary embodiment, an apparatus includes at least one bracket and at least one shelf member. The bracket includes an upper surface, at least one engagement member for engaging a standard to mount the bracket to the standard, and a support surface disposed generally horizontally when the bracket is mounted to the standard to slidably support a portion of a drawer. The bracket's upper surface includes at least one generally U-shaped indent and at least one through-hole extending downwardly through the bracket's upper surface. The shelf member includes first and second engagement portions configured to engage the respective indent and through-hole of the bracket's upper surface for restraining generally horizontal movement of the shelf member relative to the bracket.

Another exemplary embodiment includes a bracket mountable to a standard for supporting a drawer and a shelf member having first and second engagement portions. The bracket includes at least one engagement member for engaging the standard to mount the bracket to the standard. The bracket also includes a support surface extending generally horizontally when the bracket is mounted to the standard to slidably support a portion of the drawer. The bracket further includes a shelf support adjacent the support surface for supporting the shelf member. The bracket has oppositely facing grooves with a surface of one of the grooves forming the support surface, and a surface of the groove forming an upper surface of the bracket. The bracket's upper surface includes an indent and an aperture through the upper surface for engagingly receiving the respective first and second engagement portions of the shelf member for restraining generally horizontal movement of the shelf member relative to the bracket.

Another exemplary embodiment includes a shelf member supportable by an upper surface of at least one bracket mountable to a standard. The shelf member includes a shelf deck for supporting one or more items thereon. The shelf member also includes at least one engagement portion having a generally concave curvature curving generally downwardly relative to shelf deck for engagement around an indent defined by the bracket's upper surface. The shelf member further includes at least one generally downward projection configured for insertion within a through-hole defined by the bracket's upper surface. The engagement of the shelf member's engagement portion and downward projection with the respective indent and through-hole of the bracket restrains generally horizontal movement of the shelf member relative to the bracket.

In another exemplary embodiment, an apparatus includes at least one shelf member, at least one bracket, and at least one resilient drawer stop. The bracket includes at least one engagement member for engaging a standard to mount the bracket to the standard, a support surface disposed generally horizontally when the bracket is mounted to the standard to slidably support a portion of a drawer, and a shelf support adjacent the support surface for supporting the shelf member. The resilient drawer stop is configured to resist completely sliding a drawer from the bracket's support surface. The resilient drawer stop includes a first end portion engaged to the shelf member, a second end portion, and at least first and second curved portions alternating in curvature extending from about the first end portion towards the second end portion. The second end portion is configured for engaging a rearward portion of the drawer when the drawer is slidably moved along the bracket's support surface to a first position to thereby resist sliding movement of the drawer along the bracket's support surface beyond the first position.

According to another aspect of the present disclosure, there is provided a resilient drawer stop that is configured to resist completely sliding a drawer off a support surface of a bracket. The resilient drawer stop includes a first end portion, a second end portion, and at least first and second curved portions alternating in curvature extending from about the first end portion towards the second end portion. When the first end portion is engaged to a member generally above the drawer, the second end portion will engage a rearward portion of the drawer at a first position to thereby resist sliding movement of the drawer along the brackets support surface beyond the first position.

Further aspects and features of the present disclosure will become apparent from the detailed description provided hereinafter. In addition, any one or more aspects and features of the present disclosure may be implemented individually or in any combination with any one or more of the other aspects and features of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
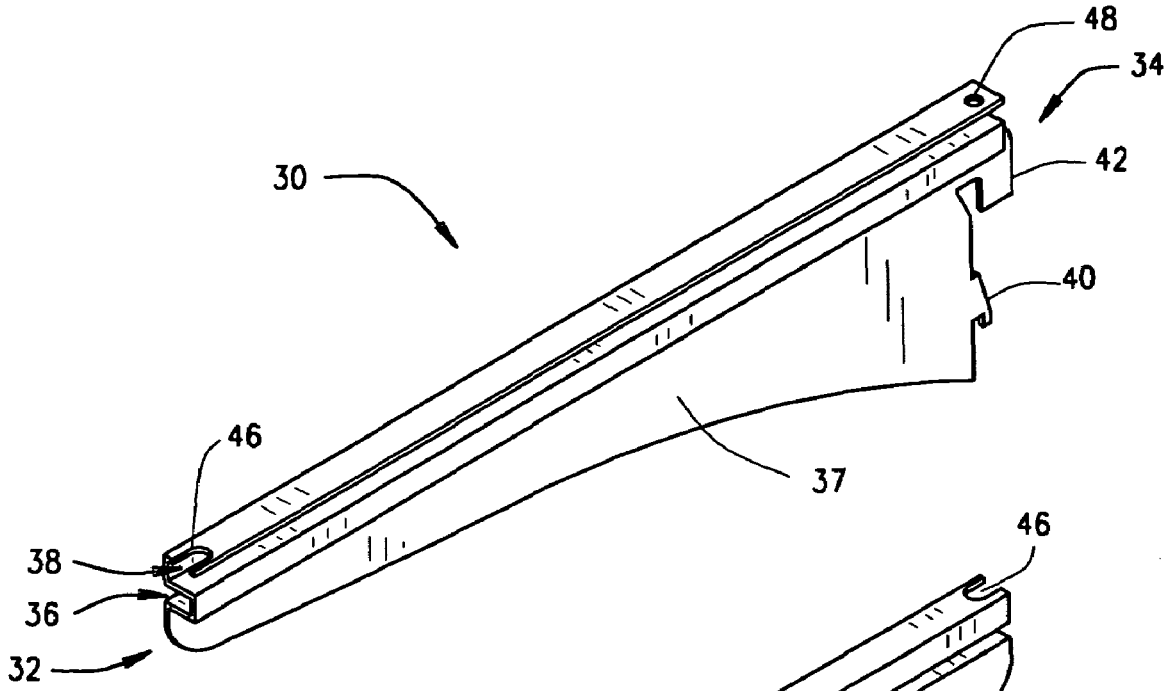
FIG. 1 is a front perspective view of a right drawer bracket according to one exemplary embodiment of the present disclosure.

The following description is merely exemplary in nature and is in no way intended to limit the present disclosure, application, or uses. It should be understood that throughout the drawings, corresponding reference numerals indicate like or corresponding parts and features.

According to various aspects of the present disclosure, there are provided various exemplary embodiments of shelves, resilient drawer stops, and drawer brackets mountable to wall-mounted standards for supporting shelves and drawers. Other aspects include systems and apparatus including one or more of such shelves, resilient drawer stops, and/or drawer brackets.

In one exemplary embodiment, an apparatus includes at least one bracket and at least one shelf member. The bracket includes an upper surface, at least one engagement member for engaging a standard to mount the bracket to the standard, and a support surface disposed generally horizontally when the bracket is mounted to the standard to slidably support a portion of a drawer. The bracket's upper surface includes at least one generally U-shaped indent and at least one through-hole extending downwardly through the bracket's upper surface. The shelf member includes first and second engagement portions configured to engage the respective indent and through-hole of the bracket's upper surface for restraining generally horizontal movement of the shelf member relative to the bracket.

Another exemplary embodiment includes a bracket mountable to a standard for supporting a drawer and a shelf member having first and second engagement portions. The bracket includes at least one engagement member for engaging the standard to mount the bracket to the standard. The bracket also includes a support surface extending generally horizontally when the bracket is mounted to the standard to slidably support a portion of the drawer. The bracket further includes a shelf support adjacent the support surface for supporting the shelf member. The bracket has oppositely facing grooves with a surface of one of the grooves forming the support surface, and a surface of the groove forming an upper surface of the bracket. The bracket's upper surface includes an indent and an aperture through the upper surface for engagingly receiving the respective first and second engagement portions of the shelf member for restraining generally horizontal movement of the shelf member relative to the bracket.

Another exemplary embodiment includes a shelf member supportable by an upper surface of at least one bracket mountable to a standard. The shelf member includes a shelf deck for supporting one or more items thereon. The shelf member also includes at least one engagement portion having a generally concave curvature curving generally downwardly relative to shelf deck for engagement around an indent defined by the bracket's upper surface. The shelf member further includes at least one generally downward projection configured for insertion within a through-hole defined by the bracket's upper surface. The engagement of the shelf member's engagement portion and downward projection with the respective indent and through-hole of the bracket restrains generally horizontal movement of the shelf member relative to the bracket.

In another exemplary embodiment, an apparatus includes at least one shelf member, at least one bracket, and at least one resilient drawer stop. The bracket includes at least one engagement member for engaging a standard to mount the bracket to the standard, a support surface disposed generally horizontally when the bracket is mounted to the standard to slidably support a portion of a drawer, and a shelf support adjacent the support surface for supporting the shelf member. The resilient drawer stop is configured to resist completely sliding a drawer from the bracket's support surface. The resilient drawer stop includes a first end portion engaged to the shelf member, a second end portion, and at least first and second curved portions alternating in curvature extending from about the first end portion towards the second end portion. The second end portion is configured for engaging a rearward portion of the drawer when the drawer is slidably moved along the bracket's support surface to a first position to thereby resist sliding movement of the drawer along the bracket's support surface beyond the first position.

According to another aspect of the present disclosure, there is provided a resilient drawer stop that is configured to resist completely sliding a drawer off a support surface of a bracket. The resilient drawer stop includes a first end portion, a second end portion, and at least first and second curved portions alternating in curvature extending from about the first end portion towards the second end portion. When the first end portion is engaged to a member generally above the drawer, the second end portion will engage a rearward portion of the drawer at a first position to thereby resist sliding movement of the drawer along the bracket's support surface beyond the first position.

Further aspects of the present disclosure include drawer brackets for use with standards and that can support drawers and allow sliding operation thereof. In various exemplary embodiments, a drawer bracket can provide for supporting shelving thereon (e.g., supporting ventilated shelving thereon, etc.) with drawers maintained thereunder. The drawer bracket can be configured to receive and support a drawer between two parallel brackets mounted to conventional standards, and also allow for sliding operation of the drawer without requiring wheels, rollers, or other sliding members. The drawer bracket can also be configured for removable connection to standards.

In one exemplary embodiment of the present disclosure, a bracket for use in connection with standards includes a drawer receiving channel for receiving therein the lip of a drawer and configured to allow for sliding of the drawer lip therethrough. The drawer receiving channel may include a generally horizontally extending support surface and may have a generally U-shaped cross-section. Further, the bracket may have a generally U-shaped top channel facing oppositely to the drawer receiving channel and together forming a generally S-shaped cross-section. A shelf member configured for removable connection to a pair of brackets also may be provided.

In another exemplary embodiment of the present disclosure, a bracket for mounting on a standard to slidably support a drawer includes at least one engagement member for engaging the standard to mount the bracket on the standard, and a support surface formed in the bracket and extending generally horizontally when the bracket is mounted on the standard to slidably support a portion of the drawer. The support surface may include opposing top and bottom walls and/or a wall of a laterally facing groove in the bracket. The bracket may further include a laterally facing groove having opposed upper and lower surfaces, with the lower surface forming the support surface.

In still another exemplary embodiment of the present disclosure, a drawer system for mounting a drawer in standards on a wall includes left and right brackets for mounting on standards in laterally opposed relation, with each bracket having at least one engagement member for engaging the standard to mount the bracket on the standard. A support surface formed in the bracket and extending generally horizontally when the bracket is mounted on the standard to slidably support a portion of a drawer is also provided. Further, a drawer adapted to be slidably mounted between the left and right brackets is provided, with the drawer having left and right flanges on opposite sides for slidably engaging the support surfaces of the left and right brackets. A drawer support channel may be included having the support surface, with the drawer support channel configured having a generally U-shaped cross-section. A shelf member configured for removable connection to top portions of the left and right brackets also may be provided.

In yet another exemplary embodiment of the present disclosure, a method of mounting a drawer on standards includes forming a support surface in a bracket having at least one engagement member for engaging a standard, with the support surface configured such that a pair of brackets mounted on standards in laterally opposed relation support a drawer therebetween in a generally horizontal orientation. The support surface may be provided as part of a channel and the method further may include forming a second channel above the support channel, with each channel having a generally U-shaped cross-section and together forming a generally S-shaped cross-section. Although embodiments of a drawer bracket according to the present disclosure are described and shown having a particular shape and size for use in supporting drawers of particular dimensions, aspects of the present disclosure are not so limited, and different shapes and sizes of brackets may be used for supporting different types and sizes of shelves.

Figure 2:
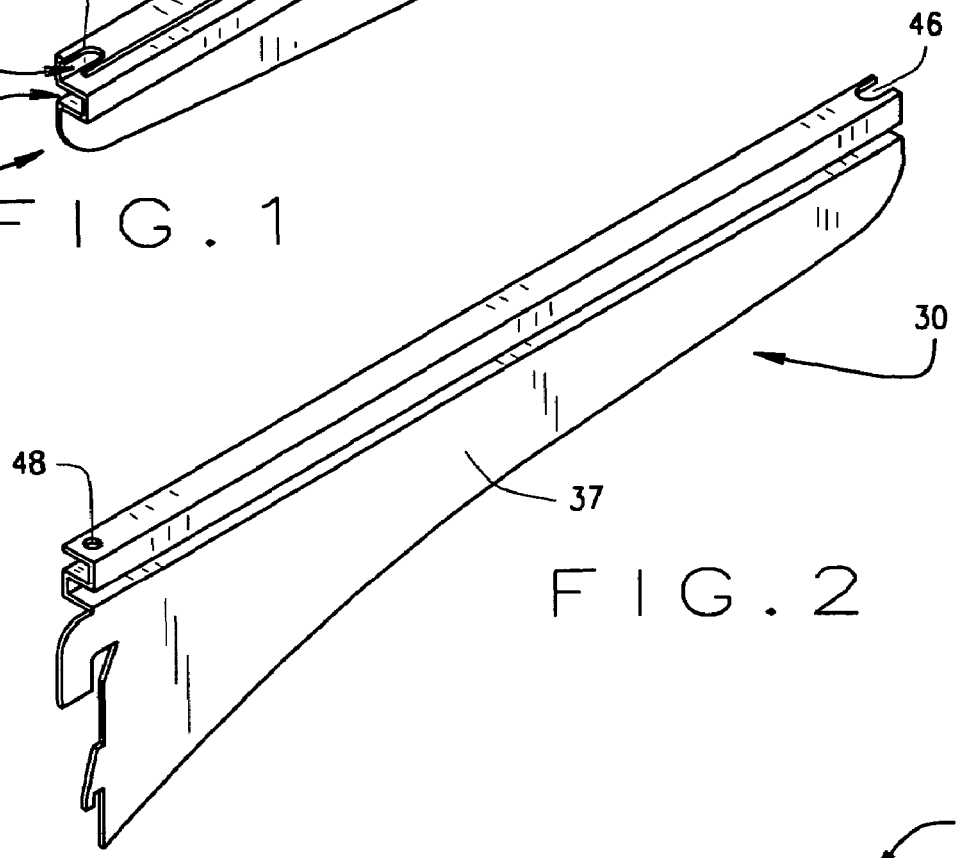
FIG. 2 is a back perspective view of the drawer bracket shown in FIG. 1.
Figure 3:
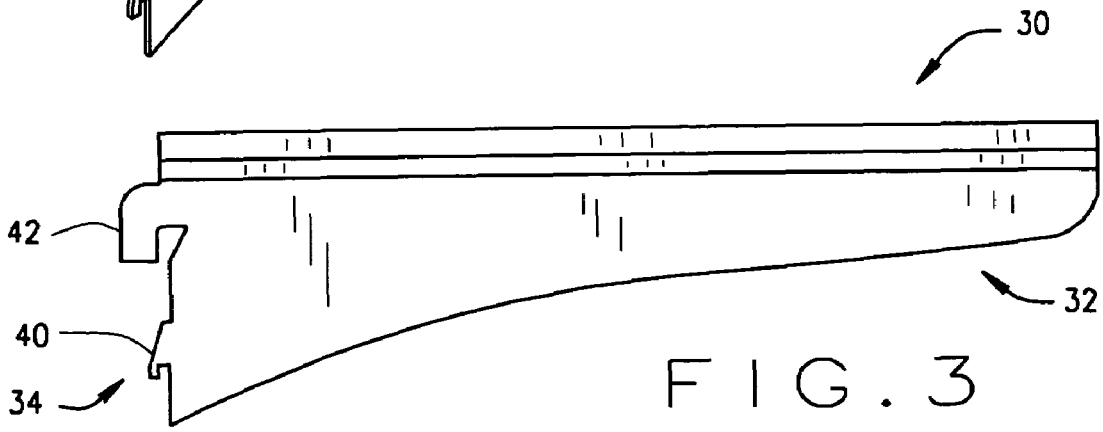
FIG. 3 is a side elevation view of the drawer bracket shown in FIG. 2.
Figure 4:
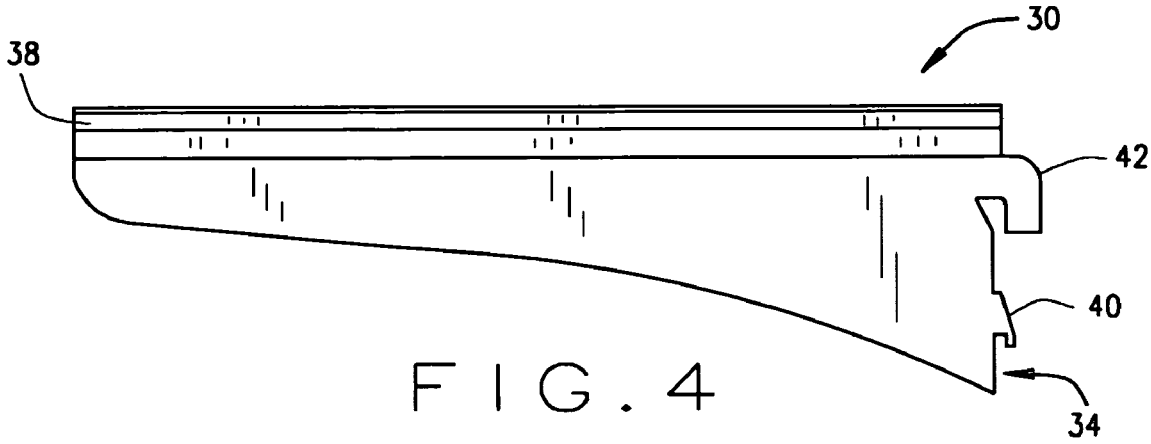
FIG. 4 is a side elevation view of the drawer bracket shown in FIG. 1.

Referring now to FIGS. 1 and 2, there is shown an exemplary drawer bracket 30 (and more specifically a right drawer bracket). A left drawer bracket constructed according to the principles of the present disclosure can have the same configuration, but be a mirror image of the right drawer bracket 30.

As shown in FIGS. 1 and 2, the drawer bracket 30 can be constructed as a one piece member having a first end 32 and a second end 34. The first end 32 is configured for receiving therein a drawer to be supported by the drawer bracket 30. The second end 34 is configured for attachment to a support member, such as a conventional wall-mounted standard.

Figure 7:
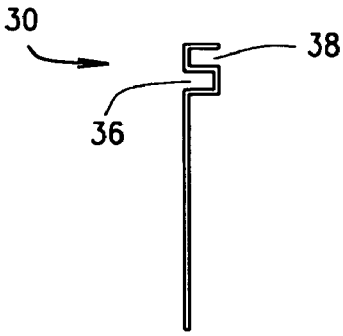
FIG. 7 is a front elevation view of the drawer bracket shown in FIG. 1.
Figure 8:
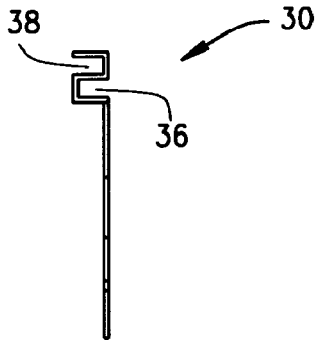
FIG. 8 is a rear elevation view of the drawer bracket shown in FIG. 1.
Figure 9:
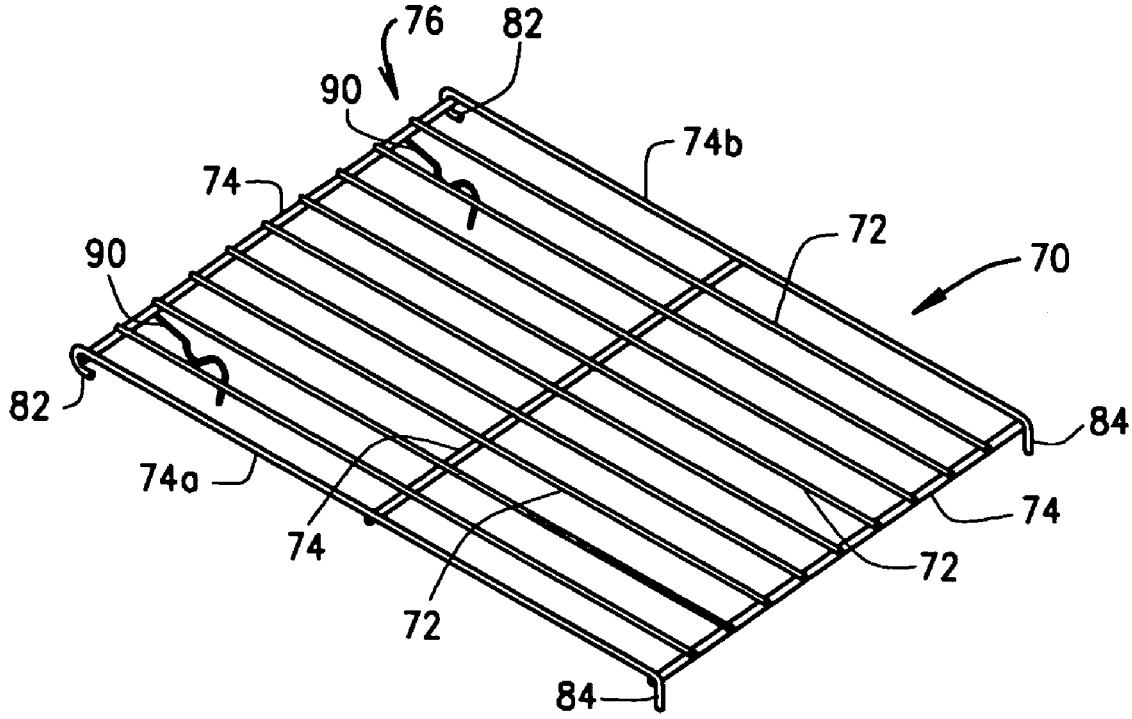
FIG. 9 is a top perspective view of an exemplary shelf member that can be used with various exemplary embodiments of a drawer bracket according to the present disclosure.

A drawer receiving channel 36 extends from the first end 32 to the second end 34. The drawer receiving channel 36 is located above a bracket support member or web 37 and below a top channel 38. The drawer receiving channel 36 has a generally U-shaped cross-section oriented sideways so that the drawer receiving channel 36 has an upper and lower wall, and a back wall smoothly connected to the upper and lower walls. The top channel 38 has a similar configuration and faces oppositely, with the drawer receiving channel 36 and top channel 38 forming a generally S-shaped cross-section as shown in FIGS. 7 and 8. This configuration can help stiffen the drawer bracket 30 against flexing and bending. It should be noted that the configuration of the drawer receiving channel 36 may be modified as needed or desired. For example, the drawer receiving channel 36 may be constructed having the upper and lower walls and no back wall, thereby forming a longitudinally extending slit between the first end 32 and the second end 34.

In an exemplary construction, the bracket support member or web 37 is configured generally downward sloped from the first end 32 to the second end 34. Specifically, the bracket support member or web 37 widens towards the second end 34 and narrows or tapers towards the first end 32.

The second end 34 includes a first engagement member 40 and a second engagement member 42 configured for attaching the drawer bracket 30 to a support member. By way of example, the engagement members 40 and 42 can be configured for attaching the drawer bracket 30 to a wall-mounted standard. In one particular embodiment, the first engagement member 40 and second engagement member 42 are configured to fit in the longitudinally extending slots in a standard (e.g., such as slots 97 of standard 91 shown in FIG. 12, etc.) to maintain the drawer bracket 30 in a generally horizontal orientation. The engagement members 40 and 42 are configured for receiving an engaging portion of the wall-mounted standard surrounding the slots. It should be noted that the configuration of each of the first engagement member 40 and second engagement member 42 may be modified based upon the particular mounting requirements, for example, the size and shape of the particular standard or other support member to which the drawer bracket 30 is to be mounted. Any other method of mounting the drawer bracket 30 can be used without departure from this present disclosure.

As shown in FIGS. 7 and 8, the drawer receiving channel or groove 36 extends substantially the entire length of the drawer bracket 30 from the first end 32 to the second end 34 below and adjacent to the top channel 38 to form the generally S-shaped cross-section. The drawer receiving groove 36 is configured to slidably receive the top lip or flange of a drawer therein and to allow for sliding of the drawer between the first end 32 and the second end 34.

Figure 11:
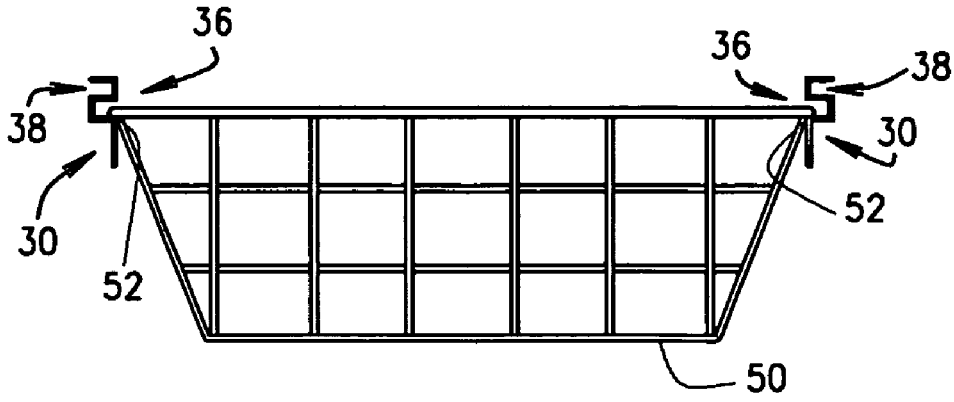
FIG. 11 is a front elevation view showing an exemplary wire basket supported by exemplary drawer brackets according to one exemplary embodiment of the present disclosure.

As shown in the example of FIG. 11, two drawer brackets 30 having oppositely facing drawer receiving channels 36 (e.g., left and right drawer brackets 30) are configured for connection to conventional wall-mounted standards using the first engagement member 40 and second engagement member 42. The left and right brackets 30 are shown supporting therebetween a drawer (e.g., such as a wire basket 50, etc.) in a generally horizontal orientation. The drawer brackets 30 allow for sliding movement of top side edges or lips 52 (e.g., flanges) of the wire basket 50 through the drawer receiving channel 36.

The configuration of the drawer receiving channel 36 and top channel 38 may be modified to receive different drawers. For example, the shape and length of the drawer receiving channel 36 and top channel 38 may be modified as needed or desired.

Figure 5:
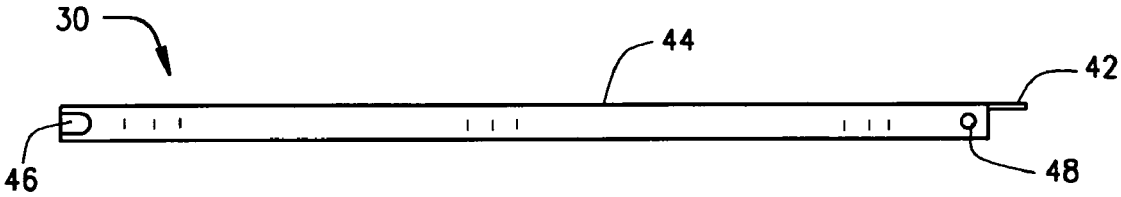
FIG. 5 is a top plan view of the drawer bracket shown in FIG. 1.
Figure 6:
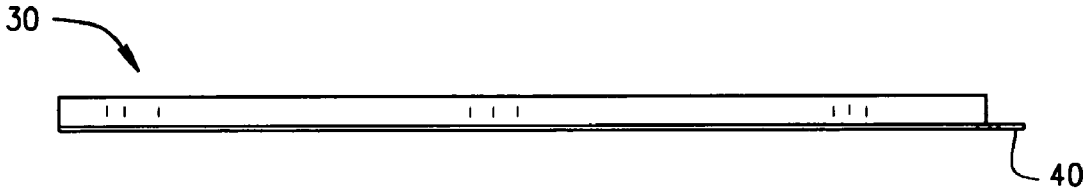
FIG. 6 is a bottom plan view of the drawer bracket shown in FIG. 1.

Referring now to FIG. 5, the upper wall of the top channel 38 forms the upper surface 44 thereof, and has means for restraining the generally horizontal movement of a shelf member. In one exemplary embodiment, this means for restraining includes an indent 46 at the first end 32 of the drawer bracket 30 and an aperture 48 adjacent the second end 34 of the drawer bracket 30. The indent 46 and aperture 48 are configured to receive engagement portions of a shelf member as described and shown herein. In the illustrated embodiment of FIG. 5, the indent 46 is generally U-shaped, and the aperture 48 comprises a circular through-hole defined through the upper surface 44. Alternative embodiments can include different types of openings (e.g., recess, void, cavity, slot, groove, hole, depression, etc) having different configurations (e.g., shapes, sizes, locations, etc.) other than the generally U-shaped indent 46 and circular through-hole 48 shown in the figures.

FIGS. 9, 10A, 10B, and 10C illustrate an exemplary shelf member 70 that may be used with the drawer brackets 30 (or other drawer brackets of the present disclosure). In the illustrated embodiment, the shelf member 70 includes a plurality of wire members 72 (e.g., wire stringers, etc.) and a plurality of support members 74 that cooperatively form a shelf deck 76. Further, members 74*a* and 74*b* form the sides of the shelf portion 70.

Figure 10A:
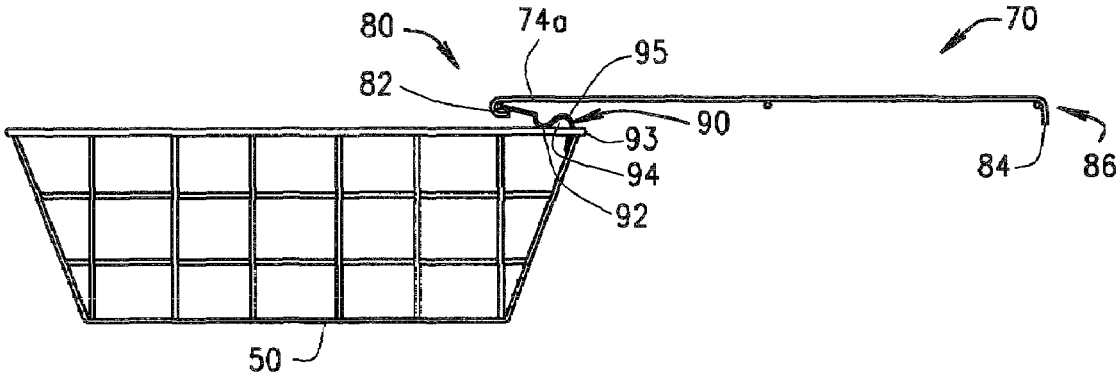
FIG. 10A is a side elevation view of the shelf member shown in FIG. 9 with a resilient drawer stop engaged to a rearward portion of a drawer according to one exemplary embodiment of the present disclosure.
Figure 10B:
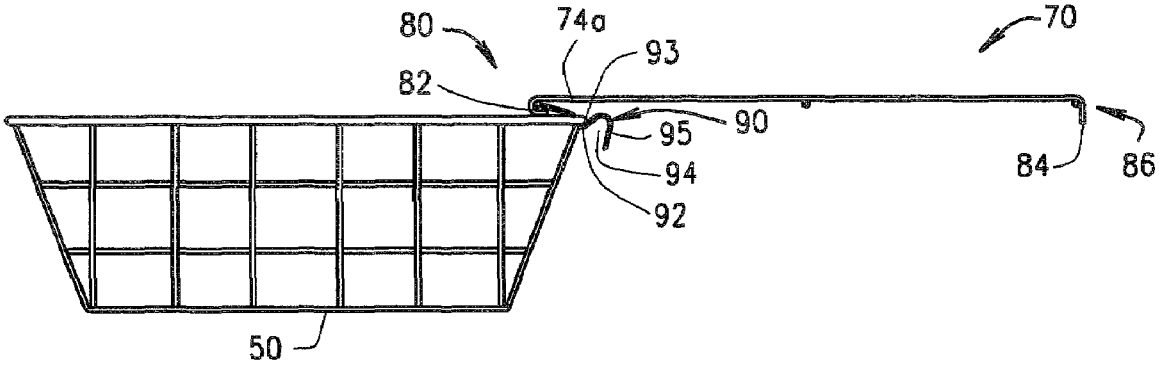
FIG. 10B is another side elevation view of the shelf member, resilient drawer stop, and drawer shown in FIG. 10A wherein the drawer's rearward portion is engaged to the resilient drawer stop member at a second position.
Figure 10C:
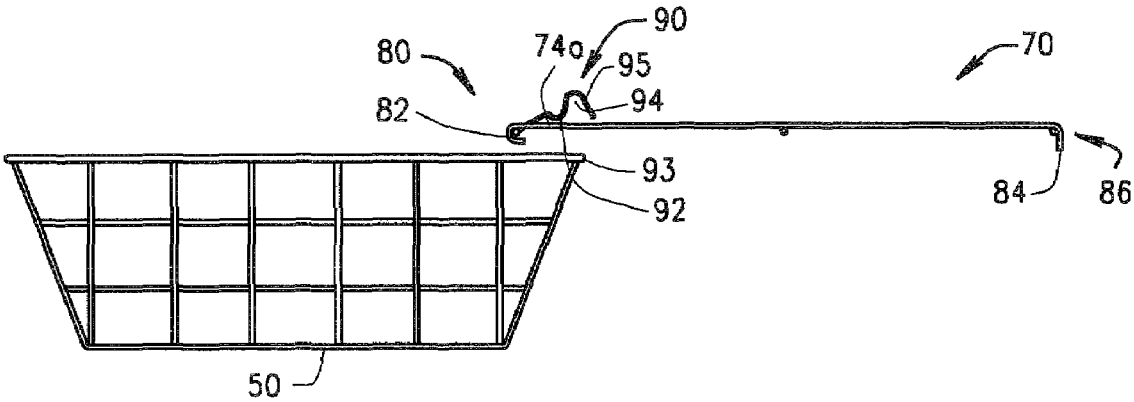
FIG. 10C is another side elevation view of the shelf member, resilient drawer stop, and drawer shown in FIGS. 10A and 10B wherein the resilient drawer stop has been moved generally upward such that the drawer may be slidably moved under the drawer stop member.

In this particular embodiment as shown in FIGS. 10A, 10B, and 10C, each longitudinally extending support member 74*a* and 74*b* includes at a front end 80 a first engagement portion 82 for engaging the indent 46 on the upper surface 44 of the top channel 38 (FIG. 5). With continued reference to FIGS. 10A, 10B, and 10C, each longitudinally extending support member 74*a* and 74*b* also includes a second engagement portion 84 at a back end 86 for engaging the aperture 48 on the upper surface 44 of the top channel 38 (FIG. 5). In the illustrated embodiment, the first engagement portion 82 is configured generally downwardly and concave for engagement around the indent 46 and for extending a distance into the top channel 38. The second engagement portion 84 is configured as a generally downward projection for insertion within the aperture 48. The first engagement portions 82 and the second engagement portions 84 are thereby configured to provide relatively secure engagement of the shelf member 70 to a pair of drawer brackets 30 (e.g., left and right drawer brackets, etc.). This way the shelf member 70 can help stabilize the drawer brackets 30 by helping to maintain separation between the drawer brackets 30, thereby helping to keep the drawer engaged between them. But the shelf member 70 is not essential to all embodiments and drawer brackets of the present disclosure can function to support a drawer without a shelf member. In addition, other embodiments can include a shelf member having differently configured engagement portions than what is shown in the figures.

In various embodiments, the shelf member 70 (or other suitable shelf member, etc.) can include one or more resilient drawer stop members 90 for resisting a drawer (e.g., wire basket 50, etc.) supported between two drawer brackets 30 from being pulled completely from the front end 32 of the drawer brackets 30 and/or for locking a drawer (e.g., wire basket 50, etc.) in one or more at least partially opened positions.

In the illustrated embodiment shown in FIGS. 9, 10A, 10B, and 10C, each drawer stop member 90 has a first end portion engaged to the shelf member 70. In this particular embodiment, the first end portion of each drawer stop member 90 is engaged (e.g., welded, integrally attached, bonded, adhesively attached, pivotably attached, etc.) to the front longitudinally extending support member 74. Alternatively, the drawer stop members 90 may be attached at other locations depending, for example, on the particular application.

With continued reference to FIGS. 9, 10A, 10B, and 10C, each drawer stop member 90 includes a second end portion 95 and first and second curved portions 92 and 94. The first and second curved portions 92 and 94 alternate in curvature extending from about the first end portion towards the second end portion 95. The first and second curved portions 92 and 94 cooperatively define a generally "S" shape. The stop members 90 are configured to engage the back top edge portion 93 (or other suitable portion) of a wire basket 50.

In the illustrated embodiment, as the wire basket 50 is moved forward (from right-to-left in FIGS. 10A, 10B, and 10C and in the direction from the drawer bracket's back end 34 towards the drawer bracket's front end 32), the resilient drawer stop members 90 allow sliding movement of the side edges or lips 52 of the wire basket 50 through the drawer receiving channels 36 until the vertical stop portion 95 engages a rearward portion 93 of the wire basket 50 (i.e., stopped position as shown in FIG. 10A). Accordingly, engagement of the vertical stop portion 95 with the basket's rearward portion 93 inhibits or resists continued sliding movement (from right-to-left in FIGS. 10A, 10B, and 10C) of the basket beyond this stopped position.

The drawer stop member 90 is also configured for depression to allow the wire basket 50 to move past a stopped position to a more open locked position as shown in FIG. 10B. For example, as the drawer 50 is slidably moved from the position shown in FIG. 10A to the more leftward position shown in FIG. 10B, the basket's rearward portion 93 may contact the resilient drawer stop member 90 causing the resilient drawer stop member 90 to pivot or rotate generally downwardly. With the drawer stop member 90 moved downwardly, the wire basket 50 may then be slidably moved (from right to left in FIGS. 10A, 10B, and 10C) until the basket's rearward portion 93 engages with the first curved portion 92. The first curved portion 92 may then curve or bend back up as a result of the drawer stop member's resiliency. Accordingly, engagement of the first curved portion 92 with the basket's rearward portion 93 inhibits or resists continued sliding movement (from right-to-left in FIGS. 10A, 10B, and 10C) of the basket beyond this stopped position.

If removal of the wire basket 50 is desired or needed, the drawer stop members 90 may be moved generally upward (FIG. 10C) to allow the basket's rearward portion 93 to move under the drawer stop members 90, thereby allowing removal of the wire basket 50 by sliding the basket 50 completely out of the bracket's slide channels 36 (e.g., for transporting the wire basket 50 with its contents to another room, etc.).

The shelf member 70 may be connected or removed from the drawer brackets 30 as desired or needed. For example, if storage of items taller than the wire basket 50 is desired or needed, the drawer brackets 30 may be used without the shelf member 70.

Figure 12:
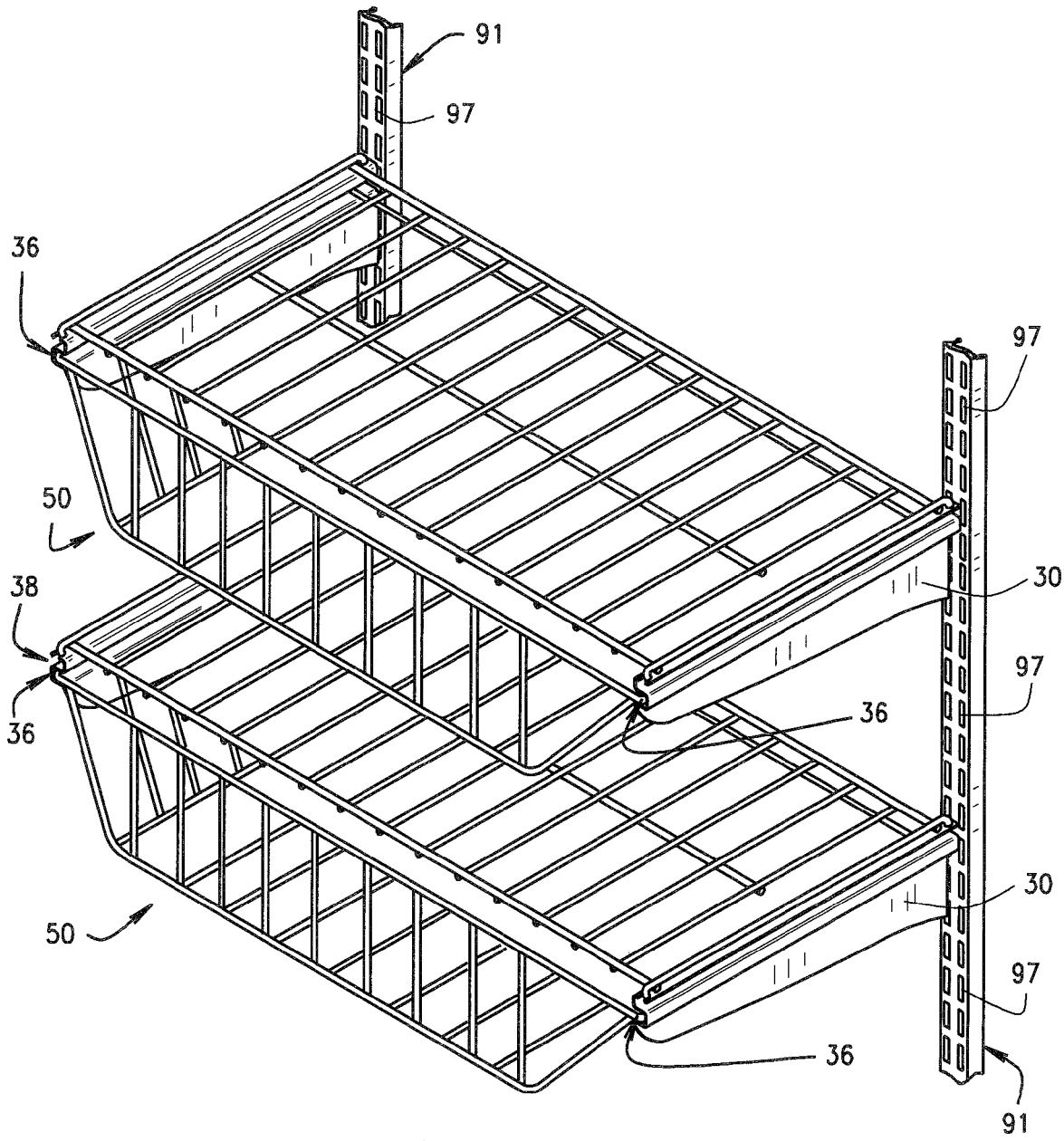
FIG. 12 is a perspective view of two pairs of exemplary drawer brackets shown connected to standards and supporting drawers according to one exemplary embodiment of the present disclosure.
Figure 13:
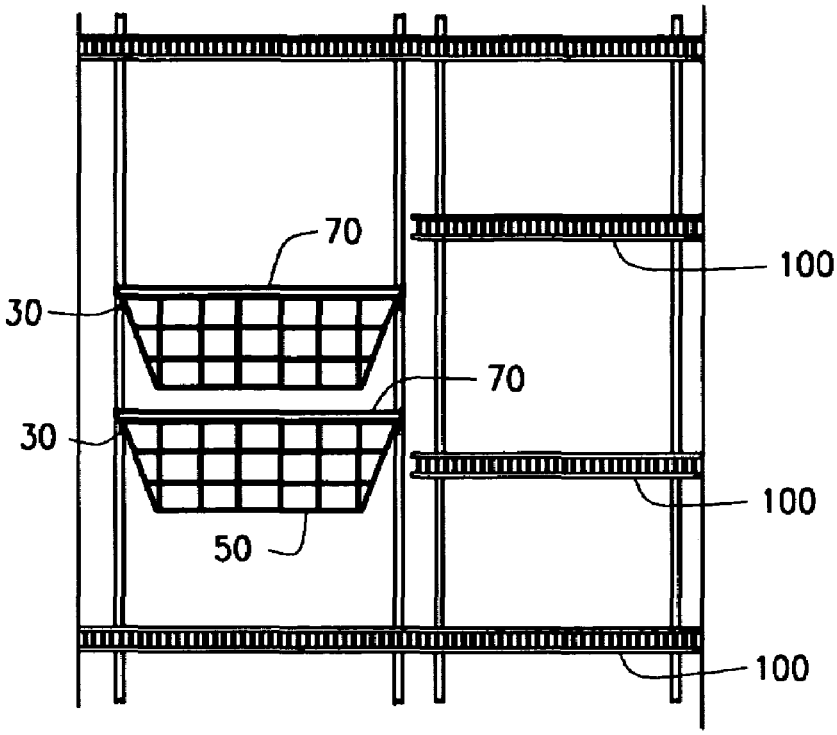
FIG. 13 is a front elevation view of exemplary drawer brackets shown connected to standards in combination with a storage unit according to one exemplary embodiment of the present disclosure.
Figure 14:
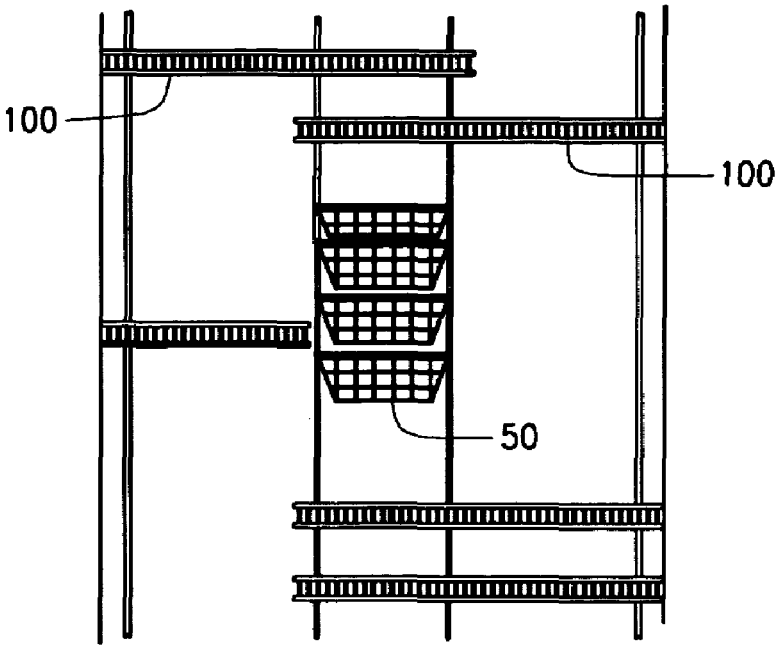
FIG. 14 is a front elevation view of exemplary drawer brackets shown connected to standards in combination with a storage unit according to one exemplary embodiment of the present disclosure.
Figure 15:
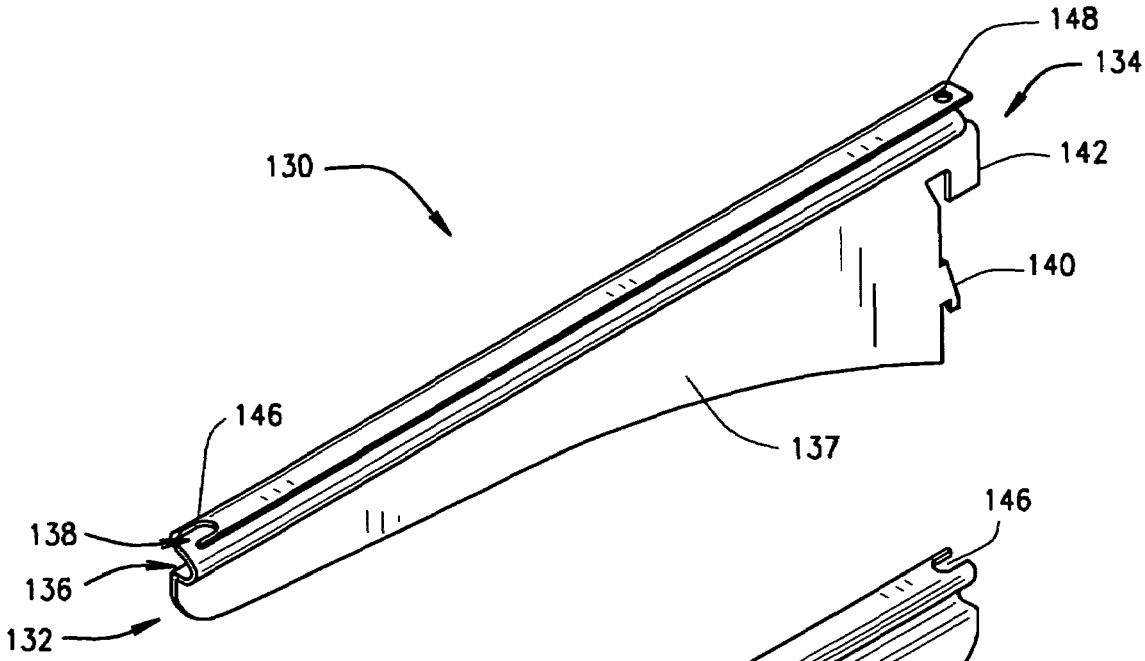
FIG. 15 is a front perspective view of a right drawer bracket according to another exemplary embodiment of the present disclosure.
Figure 16:
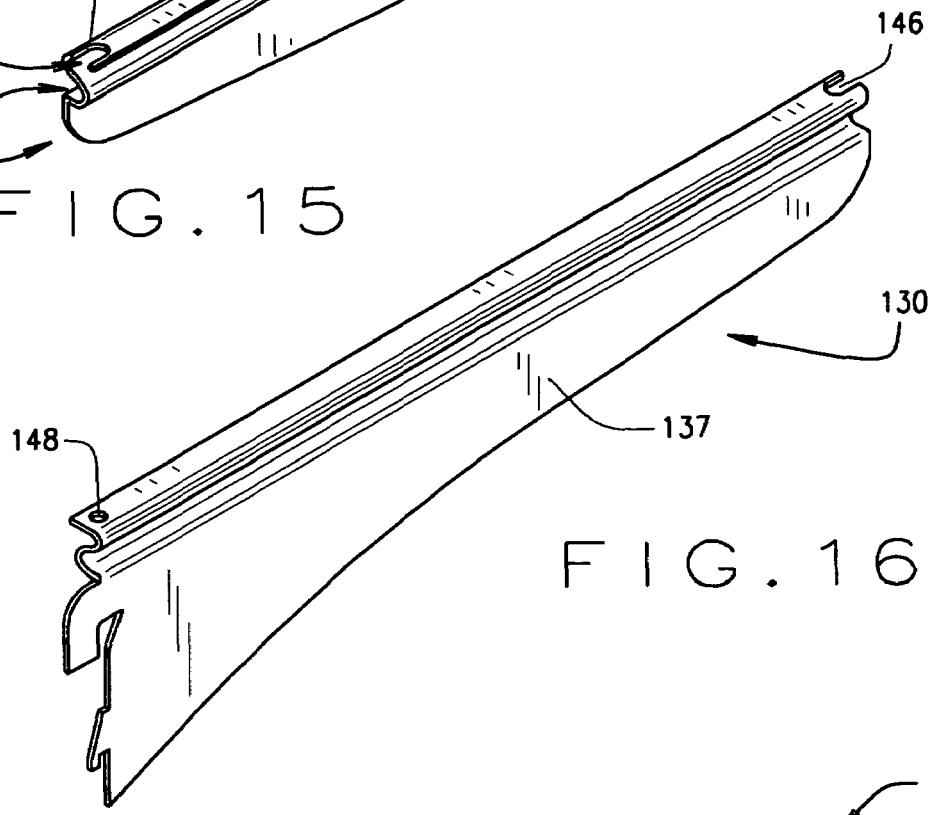
FIG. 16 is a back perspective view of the drawer bracket shown in FIG. 15.
Figure 17:
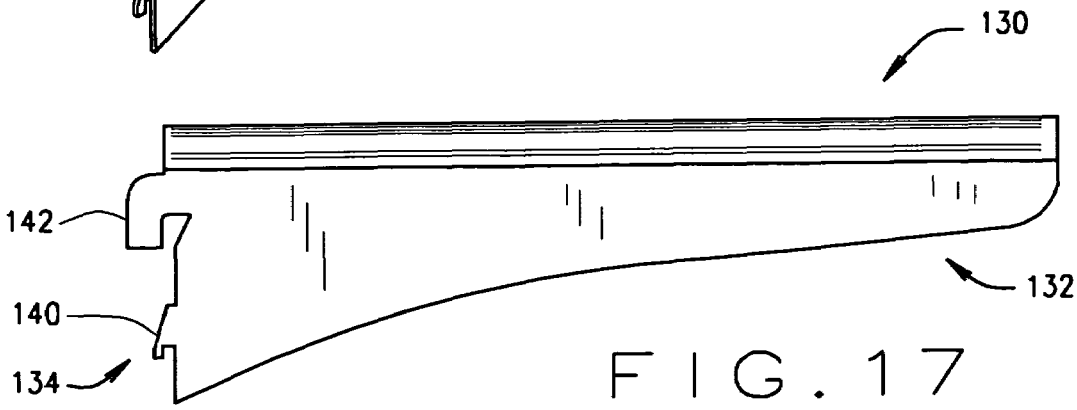
FIG. 17 is a side elevation view of the drawer bracket shown in FIG. 16.
Figure 18:
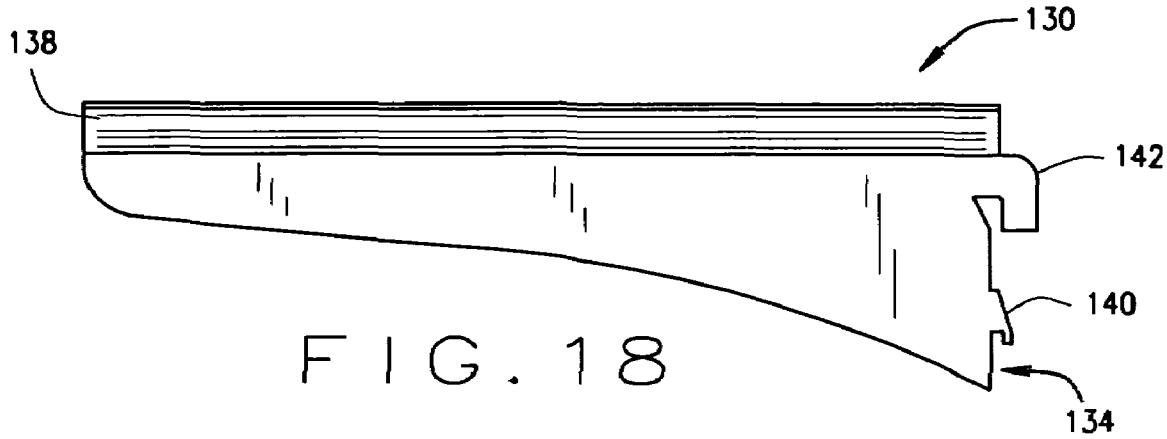
FIG. 18 is a side elevation view of the drawer bracket shown in FIG. 15.

With reference now to FIG. 12, an exemplary embodiment of a pair of drawer brackets 30 having opposing faced drawer receiving channels 36 are connected to conventional wall-mounted standards 91. A wire basket 50 or other drawer member is supported between the drawer brackets 30 and allowed to slide within the drawer receiving channels 36. Further, the shelf member 70 engages the upper surfaces 44 of the drawer brackets 30 to form a shelf deck 76 for supporting items on the shelf deck 76. It should be noted that the drawer brackets 30 may be attached at different vertical positions using different slots 97 of the standards 91. Further, the standards 91 may be mounted apart from one another at different distances to accommodate drawers, including, for example, wire baskets 50 having different widths. Further, the length of the drawer brackets 30 may be modified to accommodate different length drawers. Thus, and as shown in FIGS. 13 and 14, drawer brackets 30 of the present disclosure may be used to support wire baskets 50 (or other drawers) in combination with ventilated shelving 100, such as wire shelving, to form a storage unit (e.g., closet storage unit). In other embodiments, portions of a shelf member may be slidably positioned within top channels of a pair the brackets (e.g., 30, 130, 230, 330, etc.) for supporting the shelf member between the brackets.

FIGS. 15 through 22 illustrate a drawer bracket 130 according to another exemplary embodiment of the present disclosure. As shown, the drawer bracket 130 can be constructed as a one piece member having a first end 132 and a second end 134. The first end 132 is configured for receiving therein a drawer to be supported by the drawer bracket 130. The second end 134 is configured for attachment to a support member, such as a conventional wall-mounted standard.

A drawer receiving channel 136 extends from the first end 132 to the second end 134. The drawer receiving channel 136 is located above a bracket support member or web 137 and below a top channel 138. The drawer receiving channel 136 has a generally U-shaped cross-section oriented sideways so that the drawer receiving channel 136 has an upper and lower wall, and a back wall smoothly connected to the upper and lower walls. The top channel 138 has a similar configuration and faces oppositely, with the drawer receiving channel 136 and top channel 138 forming a generally S-shaped cross-section as shown in FIGS. 21 and 22.

The second end 134 includes a first engagement member 140 and a second engagement member 142 configured for attaching the drawer bracket 130 to a support member. By way of example, the engagement members 140 and 142 can be configured for attaching the drawer bracket 130 to a wall-mounted standard. In one particular embodiment, the first engagement member 140 and second engagement member 142 are configured to fit in the longitudinally extending slots in a standard (e.g., such as slots 97 of standard 91 shown in FIG. 12, etc.) to maintain the drawer bracket 130 in a generally horizontal orientation. The configuration of the first engagement member 140 and second engagement member 142 may be modified based upon the particular mounting requirements, for example, the size and shape of the particular standard or other support member to which the drawer bracket 130 is to be mounted. Any other method of mounting the drawer bracket 130 can be used without departure from this present disclosure.

Figure 21:
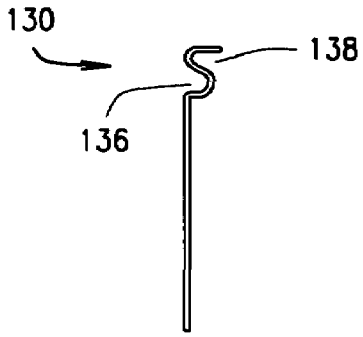
FIG. 21 is a front elevation view of the drawer bracket shown in FIG. 15.
Figure 22:
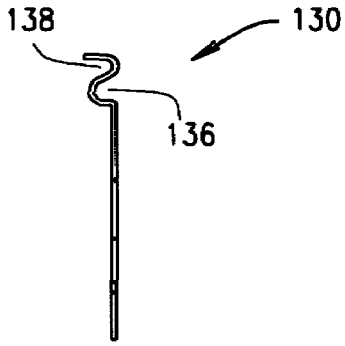
FIG. 22 is a rear elevation view of the drawer bracket shown in FIG. 15.

As shown in FIGS. 21 and 22, the drawer receiving channel or groove 136 extends substantially the entire length of the drawer bracket 130 from the first end 132 to the second end 134 below and adjacent to the top channel 138 to form the generally S-shaped cross-section. The drawer receiving groove 136 is configured to slidably receive the top lip or flange of a drawer therein and to allow for sliding of the drawer between the first end 132 and the second end 134.

It should be noted that the configuration of the drawer receiving channel 136 and top channel 138 may be modified to receive different drawers. For example, the shape and length of the drawer receiving channel 136 and top channel 138 may be modified as needed or desired.

Figure 19:
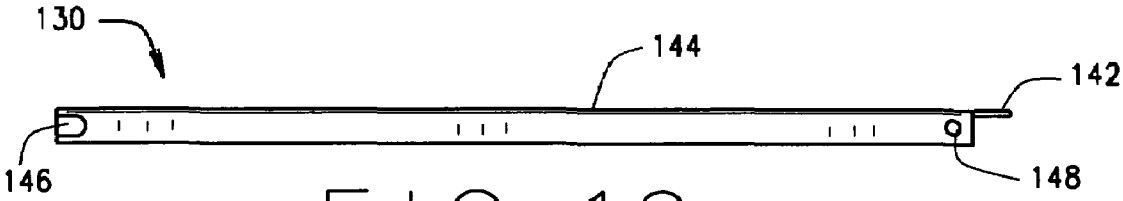
FIG. 19 is a top plan view of the drawer bracket shown in FIG. 15.
Figure 20:
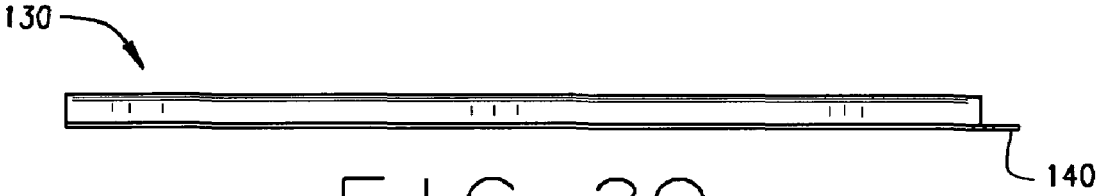
FIG. 20 is a bottom plan view of the drawer bracket shown in FIG. 15.

Referring now to FIG. 19, the upper wall of the top channel 138 forms the upper surface 144 thereof, and has means for restraining the generally horizontal movement of a shelf member. In one exemplary embodiment, this means for restraining includes an indent 146 at the first end 132 of the drawer bracket 130 and an aperture 148 adjacent the second end 134 of the drawer bracket 130. The indent 146 and aperture 148 are configured to receive engagement portions of a shelf member, such as engagement portions 82 and 84 of shelf member 70 shown in FIG. 9.

In the illustrated embodiment of FIG. 19, the indent 146 is generally U-shaped, and the aperture 148 comprises a circular through-hole defined through the upper surface 144. Alternative embodiments can include different types of openings (e.g., recess, void, cavity, slot, groove, hole, depression, etc) having different configurations (e.g., shapes, sizes, locations, etc.) other than the generally U-shaped indent 146 and circular through-hole 148 shown in the figures.

Figure 23:
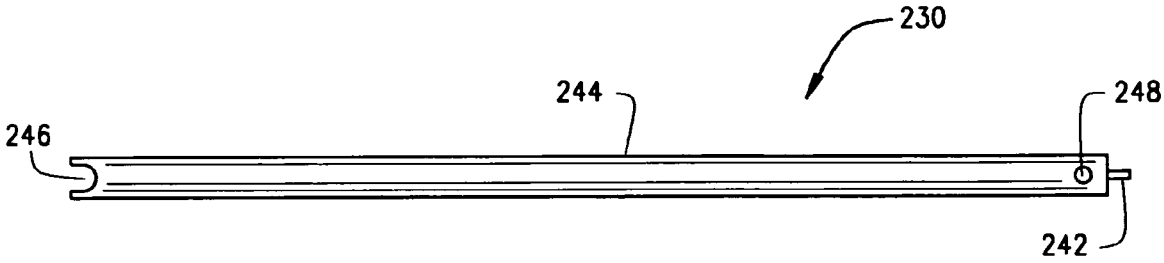
FIG. 23 is a top plan view of a drawer bracket according to another exemplary embodiment of the present disclosure.

FIG. 23 illustrates a drawer bracket 230 according to another exemplary embodiment of the present disclosure. As shown in FIG. 230, the drawer bracket 230 has an upper surface 244. The upper surface 244 includes an indent 246 and an aperture 248. The indent 246 and aperture 248 are configured to receive engagement portions of a shelf member, such as engagement portions 82 and 84 of shelf member 70 shown in FIG. 9.

In the illustrated embodiment of FIG. 23, the indent 246 is generally U-shaped, and the aperture 248 comprises a circular through-hole defined through the upper surface 244. Alternative embodiments can include different types of openings (e.g., recess, void, cavity, slot, groove, hole, depression, etc) having different configurations (e.g., shapes, sizes, locations, etc.) other than the generally U-shaped indent 246 and circular through-hole 248 shown in the figures.

The drawer bracket 230 includes at least one engagement member 242 configured for attaching the drawer bracket 230 to a support member, such as a standard mounted to a wall. But in this particular illustrated embodiment, the engagement member 242 is disposed along a generally centerline of the drawer bracket 230. The configuration (e.g., shape, size, location, number of, etc.) of the engagement member 242 may be modified based upon the particular mounting requirements, for example, the size and shape of the particular standard or other support member to which the drawer bracket 230 is to be mounted. Any other method of mounting the drawer bracket 230 can be used without departure from this present disclosure.

Figure 24:
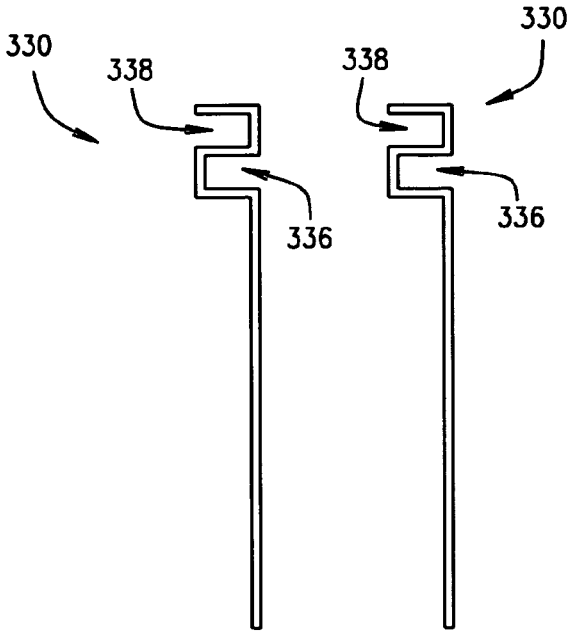
FIG. 24 is a front elevation view of a pair of left drawer brackets according to one exemplary embodiment of the present disclosure.

FIG. 24 illustrates a pair of drawer brackets 330 having lower channels 336 each facing the same general direction. The drawer brackets 330 also have upper channels 338 each facing the same general direction, but which is generally opposite the direction that the lower channels 336 are facing. In one particular embodiment, a drawer having a side flange higher on one side than the other side can be supported generally between the drawer brackets 330. In such embodiment, the drawer's higher side flange may be received within the upper channel 338 of the right side bracket 330, while the drawer's lower side flange is received within the lower channel 336 of the left side bracket. Or, for example, a shelf member (e.g., shelf member 70 shown in FIG. 9, etc.) may be supported by the brackets 330 with or without a drawer.

FIGS. 25 through 34 illustrate another embodiment 470 of a shelf member that can be used with one or more brackets (e.g., 30, 130, 230, 330, etc.) of the present disclosure. In the illustrated embodiment, the shelf member 470 includes a plurality of wire members 472 (e.g., wire stringers, etc.) and a plurality of support members 474 that cooperatively form a shelf deck 476. Further, members 474*a* and 474*b* form sides of the shelf member 470.

Figure 25:
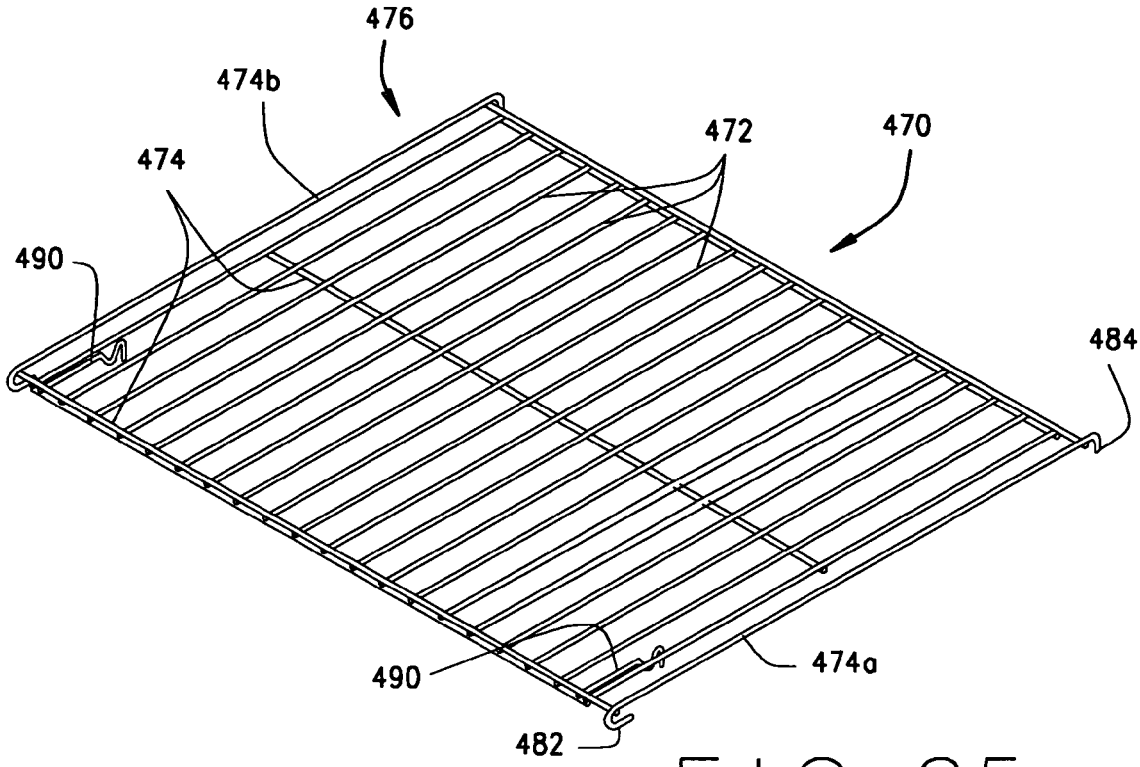
FIG. 25 is an upper perspective view of another exemplary shelf that can be used with various exemplary embodiments of a drawer bracket according to the present disclosure.
Figure 26:
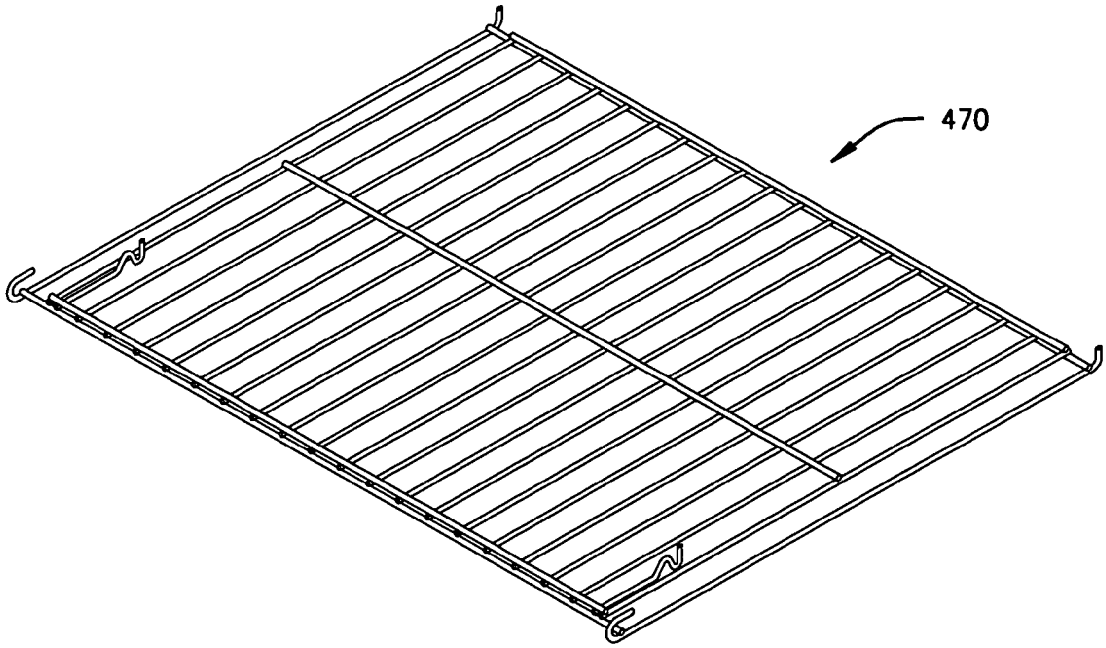
FIG. 26 is a lower perspective view of the shelf shown in FIG. 25.
Figure 27:
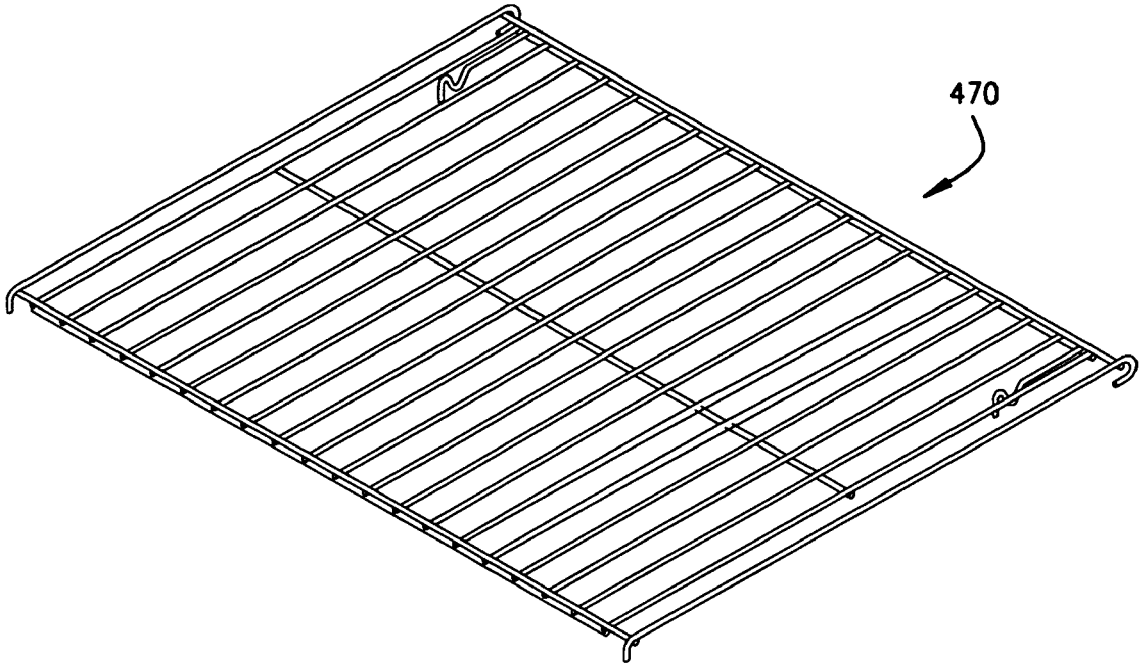
FIG. 27 is an upper rear perspective view of the SHELF shown in FIG. 25.
Figure 28:
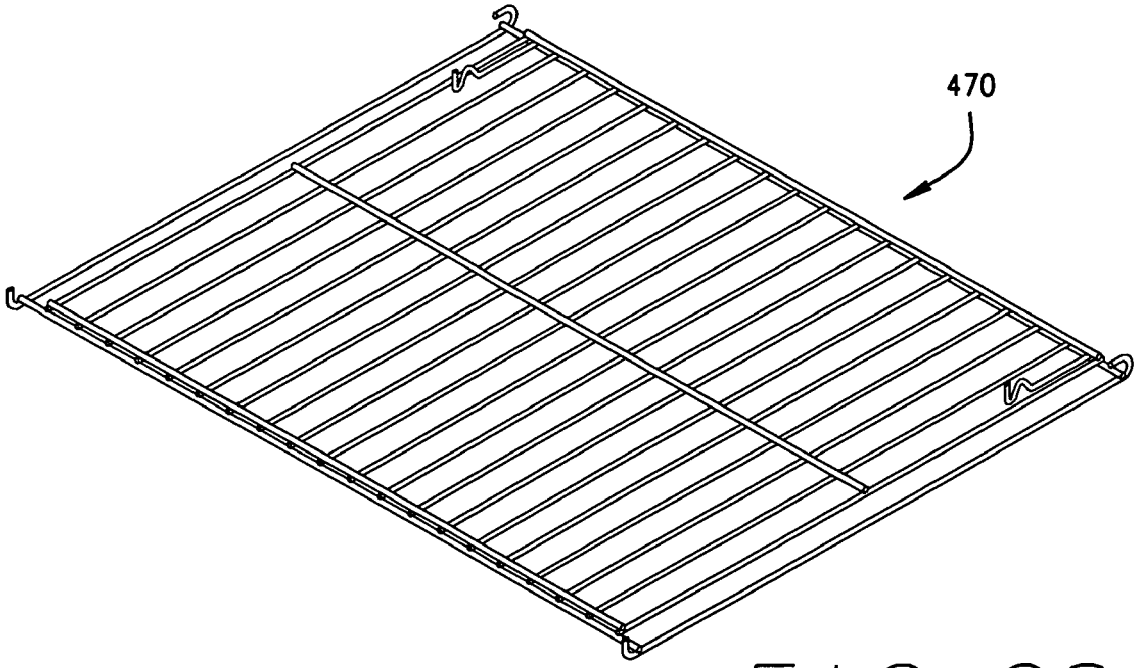
FIG. 28 is a lower rear perspective view of the SHELF shown in FIG. 25.
Figure 29:
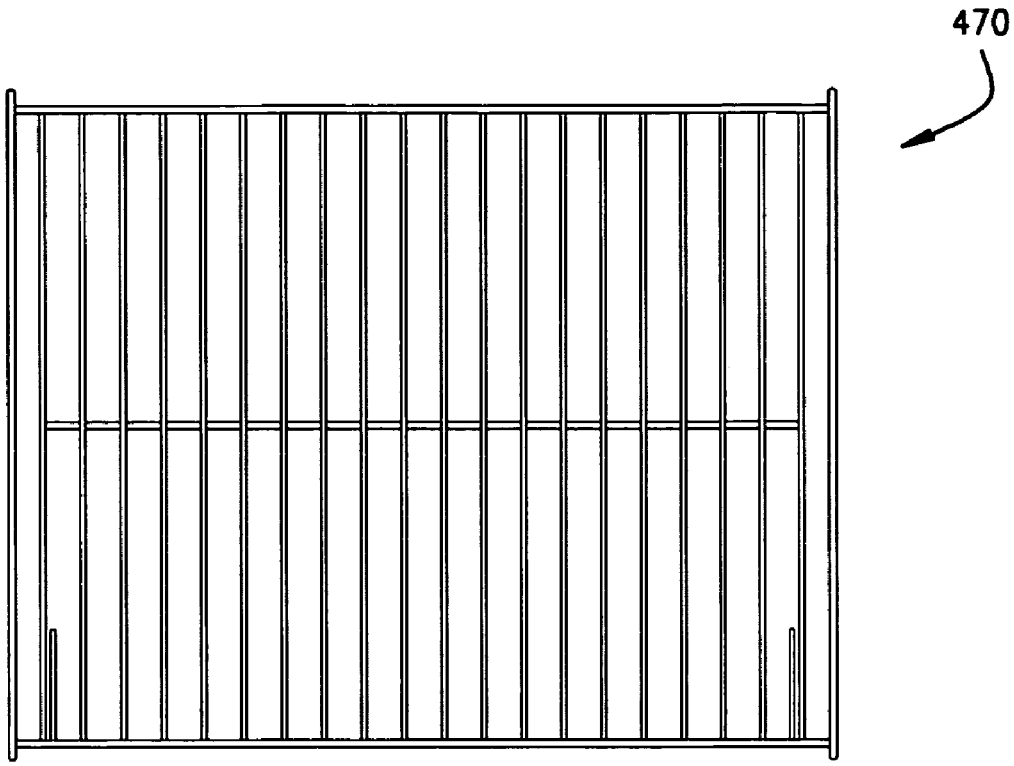
FIG. 29 is a top plan view of the SHELF shown in FIG. 25.
Figure 30:
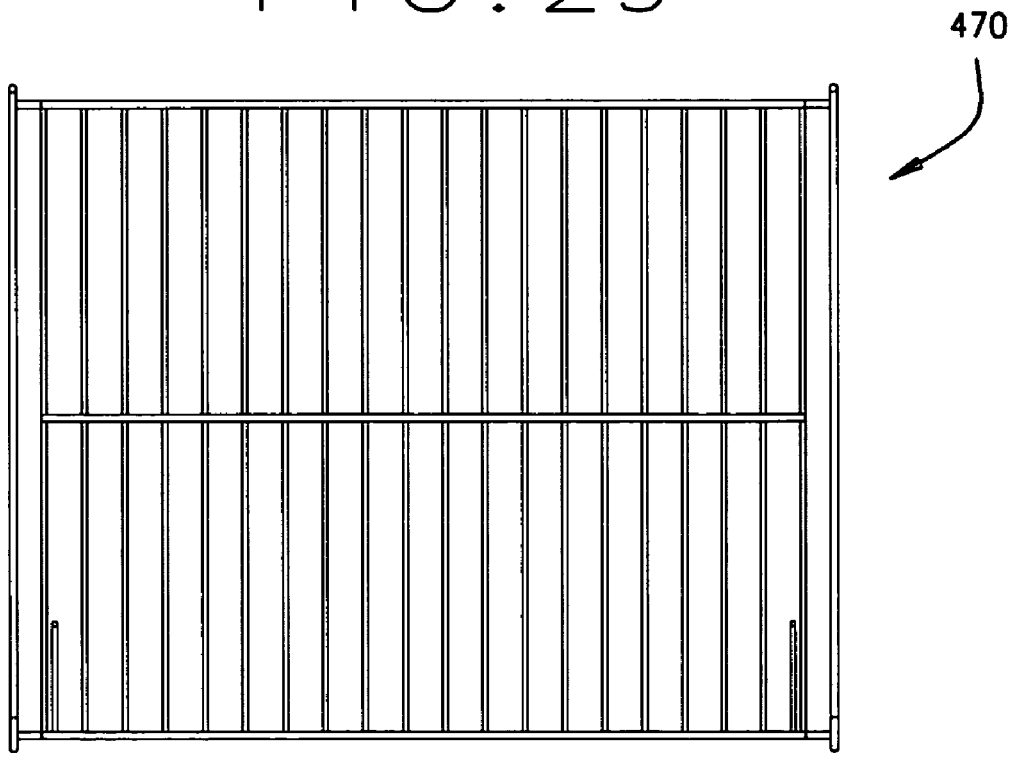
FIG. 30 is a bottom plan view of the SHELF shown in FIG. 25.
Figure 31:
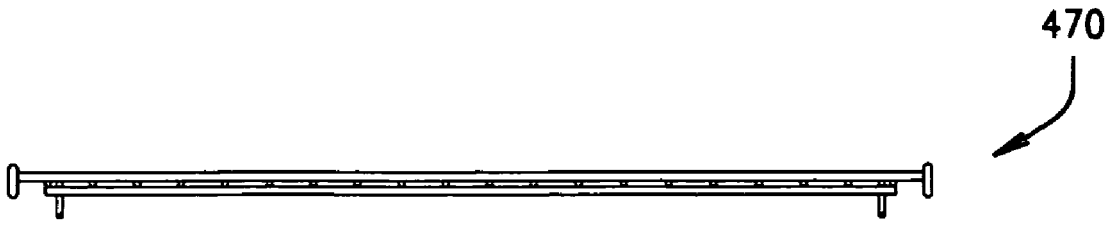
FIG. 31 is a front elevation view of the SHELF shown in FIG. 25.
Figure 32:
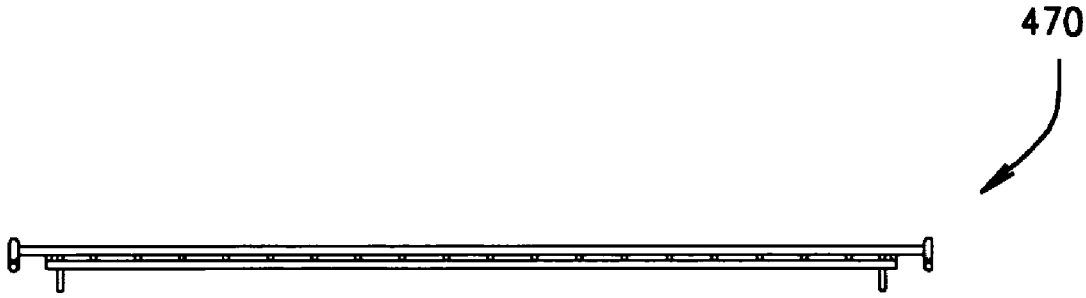
FIG. 32 is a rear elevation view of the SHELF shown in FIG. 25.
Figure 33:
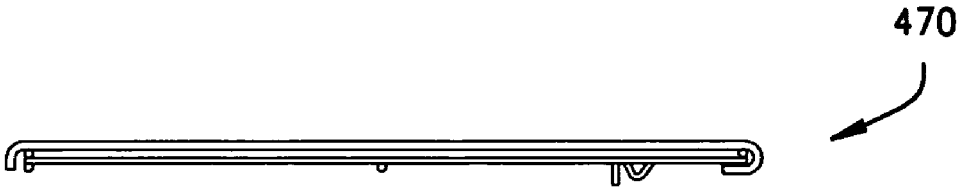
FIG. 33 is a left side elevation view of the SHELF shown in FIG. 25.
Figure 34:
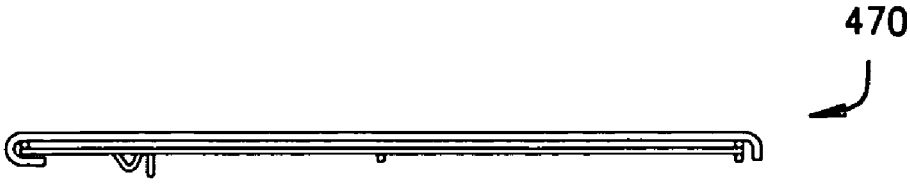
FIG. 34 is a right side elevation view of the SHELF shown in FIG. 25.

In this particular embodiment shown in FIG. 25, each member 474*a* and 474*b* includes at (or about at) a front end portion a first engagement portion 482 for engaging an indent (e.g., 46 (FIG. 5), 146 (FIG. 15), 246 (FIG. 23) etc.)) on an upper surface of a channel. With continued reference to FIG. 25, each member 474*a* and 474*b* also includes a second engagement portion 484 at (or about at) a back end portion for engaging an aperture (e.g., 48 (FIG. 5), 148 (FIG. 15), 248 (FIG. 23) etc.) on an upper surface of a channel. In the illustrated embodiment shown in FIG. 25, the first engagement portion 482 is configured generally downwardly and concave for engagement around an indent and for extending a distance into a channel. The second engagement portion 484 is configured as a generally downward projection for insertion within an aperture. The first engagement portions 482 and the second engagement portions 484 are thereby configured to provide relatively secure engagement of the shelf member 470 to a pair of drawer brackets (e.g., 30, 130, 230, 330,etc.). This way the shelf member 470 can help stabilize the drawer brackets by helping to maintain separation between the drawer brackets, thereby helping to keep the drawer engaged between them. But a shelf member is not essential to all embodiments and drawer brackets of the present disclosure can function to support a drawer without a shelf member. In addition, other embodiments can include a shelf member having differently configured engagement portions than what is shown in the figures.

In various embodiments, the shelf member 470 (or other suitable shelf member, etc.) can include one or more resilient drawer stop members 490 for resisting a drawer (e.g., wire basket 50 (FIGS. 10A, 10B, and 10C), etc.) supported between two drawer brackets from being pulled completely from the front end of the drawer brackets and/or for locking a drawer (e.g., wire basket 50 (FIGS. 10A, 10B, and 10C), etc.) in one or more at least partially opened positions. In the illustrated embodiment shown in FIGS. 25 through 34, each drawer stop member 490 has a first end portion engaged to the shelf member 470. In this particular embodiment, the first end portion of each drawer stop member 490 is welded between two members 474. Alternatively, the drawer stop members 490 may be attached using other suitable methods (e.g., integrally attached, bonded, adhesively attached, pivotably attached, etc.) and/or at other locations depending, for example, on the particular application. As described above and shown in FIGS. 10A, 10B, and 10C, the drawer stop members 490 are configured to engage a portion of a drawer or basket (e.g., a back top edge portion 93 of a wire basket 50 (FIGS. 10A 10B, and 10C), etc.).

Drawer brackets (e.g., 30, 130, 230, 330, etc.) of the present disclosure are not limited to the particular configurations as described and shown herein. Instead, drawer brackets constructed according to principles of the present disclosure may be modified to allow for use with a wide range of drawers other than what is shown in the figures, including drawers having different sizes, different drawer types, different drawer configurations, etc. For example, the size of a drawer receiving channel (e.g., 36, 136, 336, etc.) of a drawer bracket (e.g., 30, 130, 230, 330, etc.) may be modified to accommodate different sizes of drawer sides. Further, and for example, a hat-shaped support member with longitudinally extending flanges may be provided in connection with and on top of a drawer bracket to support a drawer between pairs of brackets.

In addition, drawer brackets (e.g., 30, 130, 230, 330, etc.) and/or resilient drawer stops (e.g., 90, etc.) of the present disclosure can be used with a wide range of different shelving members, storage units, storage systems, etc. Indeed, FIGS. 9 through 14 show examples of drawers, shelving members, storage units and systems in which drawer brackets and/or resilient drawer stops of the present disclosure can be used. Embodiments of the present disclosure can be used with other shelves having a different depth and/or different spacing between the shelf's wires or rod members than that shown in the figures. Plus, embodiments of the present disclosure can also be used with shelves having wires or rods oriented generally longitudinally, transversely, diagonally, etc. relative to the shelf. Accordingly, aspects of the present disclosure should not be limited to implementation into any specific form/type of shelf, drawer, storage unit, storage system, etc.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order or performance. It is also to be understood that additional or alternative steps may be employed.

The description of the present disclosure is merely exemplary in nature and, thus, variations that do not depart from the gist of the present disclosure are intended to be within the scope of the present disclosure. Such variations are not to be regarded as a departure from the spirit and scope of the present disclosure.

What is claimed is:

1. An apparatus comprising:

at least one bracket including an upper surface, at least one engagement member for engaging a standard to mount the bracket to the standard, and a support surface disposed generally horizontally when the bracket is mounted to the standard to slidably support a portion of a drawer, the bracket's upper surface including at least one generally U-shaped indent and at least one through-hole extending downwardly through the bracket's upper surface;

at least one shelf member including first and second engagement portions configured to engage the respective indent and through-hole of the bracket's upper surface for restraining generally horizontal movement of the shelf member relative to the bracket.

2. The apparatus of claim 1, wherein the first engagement portion of the shelf member includes a generally concave curvature curving generally downwardly for engagement around the indent of the bracket.

3. The apparatus of claim 1, wherein the second engagement portion of the shelf member includes a generally downward projection for insertion within the through-hole of the bracket.

4. The apparatus of claim 1, further comprising at least one resilient drawer stop engaged to the shelf member and configured to resist completely sliding a drawer from the support surface of the bracket.

5. The apparatus of claim 1, wherein the indent is defined by a forward end portion of the bracket's upper surface, and the through-hole is defined through a rearward end portion of the bracket's upper surface.

6. The apparatus of claim 1, wherein the bracket is configured to allow a generally horizontally extending lip of the drawer to be slidably moved along an entire length of the support surface.

7. A bracket mountable to a standard for supporting a drawer and a shelf member having first and second engagement portions, the bracket comprising:

at least one engagement member for engaging the standard to mount the bracket to the standard;

a support surface extending generally horizontally when the bracket is mounted to the standard to slidably support a portion of the drawer;

a shelf support adjacent the support surface for removably supporting the shelf member;

the bracket including oppositely facing grooves, a surface of one of said grooves forming the support surface, and a surface of the other one of said grooves forming an upper surface of the bracket;

the bracket's upper surface including an indent and an aperture through the upper surface for engagingly receiving the respective first and second engagement portions of the shelf member for restraining generally horizontal movement of the shelf member relative to the bracket.

8. The bracket of claim 7, wherein the indent is generally U-shaped when viewed from above.

9. The bracket of claim 7, wherein the oppositely facing grooves cooperatively form a generally S-shaped cross-section.

10. The bracket of claim 7, wherein the bracket is configured such that a generally horizontally extending lip of the drawer is slidably movable along an entire length of the support surface.

11. A shelf member removably supportable by an upper surface of at least one bracket mountable to a standard, the shelf member comprising:

a shelf deck for supporting one or more items thereon;

at least one engagement portion having a generally concave curvature curving generally downwardly relative to shelf deck for engagement around an indent defined by the bracket's upper surface;

at least one generally downward projection configured for insertion within a through-hole defined by the bracket's upper surface;

the engagement of the shelf member's engagement portion and downward projection with the respective indent and through-hole of the bracket restrains generally horizontal movement of the shelf member relative to the bracket; and at least one resilient drawer stop having a first end portion adjacent the shelf deck, a second end portion, and at least first and second curved portions alternating in curvature extending from about the first end portion towards the second end portion, the first and second curved portions cooperatively defining a generally S-shape.

12. An apparatus comprising:

at least one shelf member;

at least one bracket including at least one engagement member for engaging a standard to mount the bracket to the standard, a support surface disposed generally horizontally when the bracket is mounted to the standard to slidably support a portion of a drawer, and a shelf support adjacent the support surface for removably supporting the shelf member;

at least one resilient drawer stop configured to resist completely sliding a drawer from the bracket's support surface, the resilient drawer stop including a first end portion engaged to the shelf member, a second end portion, and at least first and second curved portions alternating in curvature extending from about the first end portion towards the second end portion, the second end portion configured for engaging a rearward portion of the drawer when the drawer is slidably moved along the bracket's support surface to a first position to thereby resist sliding movement of the drawer along the bracket's support surface beyond the first position.

13. The apparatus of claim 12, wherein the first and second curved portions of the resilient drawer stop cooperatively define a generally S-shape.

14. The apparatus of claim 12, wherein the resilient drawer stop is resiliently depressible such that depression of the resilient drawer stop allows the drawer to be slidably moved along the bracket support surface beyond the first position to a second position in which the first curved portion engages the drawer's rearward portion to thereby resist sliding movement of the drawer along the bracket's support surface beyond the second position.

15. The apparatus of claim 12, wherein the resilient drawer stop is generally upwardly movable to allow the drawer's rearward portion to be slidably moved under the resilient drawer stop for removal from the bracket.

16. The apparatus of claim 12, wherein the bracket includes an upper surface having at least one opening therethrough, and wherein the shelf member includes at least one engagement portion for engagement with the at least one opening of the bracket's upper surface for restraining generally horizontal movement of the shelf member relative to the bracket.

17. The apparatus of claim 12, wherein the bracket includes oppositely facing grooves, a surface of one of said grooves forming the support surface, and a surface of the other one of said grooves forming the shelf support.

18. The apparatus of claim 17, wherein the shelf support includes a lower surface of the other one of said grooves, and wherein the shelf member includes an edge portion configured for positioning within the other one of said grooves such that the edge portion rests upon the lower surface of the other one of said grooves.

* * * * *